US009955530B2

(12) United States Patent
Norman et al.

(10) Patent No.: US 9,955,530 B2
(45) Date of Patent: Apr. 24, 2018

(54) ULTRAVIOLET NUTRITIONAL WARMER

(71) Applicant: Neonatal Product Group, Inc., Overland Park, KS (US)

(72) Inventors: Scott Norman, Stilwell, KS (US); Mark Petheram, Overland Park, KS (US); Christian Darabant, Stilwell, KS (US); Anthony Hash, Olathe, KS (US)

(73) Assignee: AMEDA, INC., Buffalo Grove, IL (US)

( * ) Notice: Subject to any disclaimer, the term of this patent is extended or adjusted under 35 U.S.C. 154(b) by 781 days.

(21) Appl. No.: 14/451,131

(22) Filed: Aug. 4, 2014

(65) Prior Publication Data

US 2015/0037016 A1 Feb. 5, 2015

Related U.S. Application Data

(60) Provisional application No. 61/861,790, filed on Aug. 2, 2013.

(51) Int. Cl.
*A45D 20/40* (2006.01)
*H05B 3/00* (2006.01)

(52) U.S. Cl.
CPC ..... *H05B 3/0071* (2013.01)

(58) Field of Classification Search
CPC ..... H05B 3/0071; H05B 3/0085; A61L 2/10
USPC ..... 422/24; 250/455.11; 392/407
See application file for complete search history.

(56) References Cited

U.S. PATENT DOCUMENTS

| | | | | |
|---|---|---|---|---|
| 3,683,177 | A * | 8/1972 | Veloz | A61L 2/10 119/245 |
| 4,293,762 | A | 10/1981 | Ogawa | |
| 4,410,320 | A | 10/1983 | Dykstra et al. | |
| 4,532,414 | A | 7/1985 | Shah et al. | |
| 4,742,824 | A | 5/1988 | Payton et al. | |
| 5,875,282 | A | 2/1999 | Jordan et al. | |
| 6,259,074 | B1 * | 7/2001 | Brunner | A61M 5/44 219/494 |
| 6,981,794 | B2 * | 1/2006 | Bibbo | A61L 2/02 366/149 |
| 8,143,596 | B2 * | 3/2012 | Yerby | A61L 2/10 250/455.11 |
| 8,663,161 | B2 | 3/2014 | Hyun et al. | |
| 8,672,545 | B1 * | 3/2014 | Norman | B65D 31/04 206/459.1 |
| 2001/0053332 | A1 * | 12/2001 | Omasa | A61L 2/025 422/22 |

(Continued)

FOREIGN PATENT DOCUMENTS

WO WO2007117634 * 10/2007

*Primary Examiner* — Dana Ross
*Assistant Examiner* — Joseph Iskra
(74) *Attorney, Agent, or Firm* — Hovey Williams LLP

(57) ABSTRACT

A feeding fluid warming system broadly includes a liner bag and an ultraviolet light warming device. The liner bag includes an inner bag that receives feeding fluid therein and an outer bag that holds warming fluid therein. The warming device includes a container, an ultraviolet light source, a temperature sensor, and a controller. The container receives the liner bag therein and the ultraviolet light source heats the warming fluid, which in turn heats the feeding fluid to temperatures within a thermal neutral zone so as to effectively and consistently maintains the fluids at these temperatures in addition to sterilizing the warming fluid.

19 Claims, 4 Drawing Sheets

(56) References Cited

U.S. PATENT DOCUMENTS

| | | | | |
|---|---|---|---|---|
| 2006/0147339 | A1* | 7/2006 | Hunter | A61L 2/10 422/24 |
| 2007/0066963 | A1 | 3/2007 | Tanghoj | |
| 2014/0207063 | A1 | 7/2014 | Hyun et al. | |
| 2015/0016809 | A1* | 1/2015 | Shields | A47J 36/2483 392/407 |

* cited by examiner

ULTRAVIOLET NUTRITIONAL WARMER

RELATED APPLICATIONS

The current non-provisional patent application claims priority benefit, with regard to all common subject matter, of an earlier-filed U.S. provisional patent application titled "ULTRAVIOLET NUTRITIONAL WARMER", Application Ser. No. 61/861,790, filed Aug. 2, 2013. The earlier-filed application is hereby incorporated by reference into the current application in its entirety.

BACKGROUND

The present invention relates to warming systems for preparing feeding fluid to be fed to infants.

Infants often require nutritional fluid such as milk or special formulas. Such fluids are often expressed from a birth mother or prepared in advance and then refrigerated until needed. Infants often accept warm fluids more easily, so the refrigerated fluids must be warmed prior to feeding. Conventional warming devices used to warm the feeding fluids typically include a fluid container and a heating element. The feeding fluids are typically placed in a feeding bottle or other container, which is then placed in the fluid container. The heating element heats the fluid container and hence the feeding fluids to a temperature of between 122° F. (49° C.) to 140° F. (60° C.). This high heat may negatively break down the nutrients in the feeding fluids such that the infant receives reduced nutritional benefit from the feeding fluids. The high heat may also introduce foreign particles from the plastic of the fluid container into the feeding fluids. The heat also encourages the growth of harmful bacteria and microbes in the fluid container, which are then transferred to the infants via the feeding fluid.

SUMMARY

The present invention solves the above-described problems and provides a distinct advance in the art of feeding fluid warming systems. More particularly, the present invention provides a feeding fluid warming system that gradually warms the nutritional fluid to a desired temperature via a warming fluid and consistently maintains the desired temperature for feeding the fluid to an infant or other person. The present invention also sterilizes the warming fluid via ultraviolet light to reduce the presence of harmful bacteria and microbes.

Applicant has discovered that many persons, and infants in particular, experience feeding tolerance issues unless the feeding fluid is warmed to a temperature within a Thermal Neutral Zone (TNZ) between 90° F. (32° C.) and 100° F. (38° C.). Temperatures within this range are ideal for enzymes in the infant's digestive system to break down the nutrients in the fluid.

An embodiment of the present invention is a feeding fluid warming system that more effectively heats nutritional feeding fluids to temperatures within the TNZ and effectively and consistently maintains the fluids at these temperatures. Importantly, the invention also sterilizes parts of the warming system via ultraviolet light. The warming system broadly includes a liner bag, similar to the one disclosed in U.S. Pat. No. 8,672,545 issued to Norman et al. (hereby incorporated in its entirety herein), and a warming device for heating the liner bag and its contents.

The liner bag includes an outer bag and an inner bag at least partially enclosed by the outer bag. The outer bag defines an outer chamber for holding a warming fluid and has an ultraviolet light permeable outer wall for allowing ultraviolet light to penetrate the warming fluid. The inner bag defines an inner chamber for receiving a feeding fluid and has an ultraviolet light unpermeable outer wall to minimize the amount of ultraviolet light penetrating the feeding fluid.

The warming device heats the warming fluid and the feeding fluid and includes a container, an ultraviolet light source, a temperature sensor, and a controller.

The container receives the liner bag therein for warming the feeding fluid and houses the ultraviolet light source, temperature sensor, and controller.

The ultraviolet light source heats and sterilizes the warming fluid and may be one or more ultraviolet light emitting diodes (LEDs), lamps, or similar ultraviolet (UV) light emitting elements. The LEDs or other UV elements emit ultraviolet light into the outer bag of the liner bag to heat and sterilize the warming fluid. Some of the heat from the heated warming fluid is then transferred to the feeding fluid to heat the feeding fluid to a temperature within the TNZ.

The temperature sensor senses a temperature of the warming fluid or the feeding fluid.

The controller receives signals representative of the temperature of the warming fluid or the feeding fluid from the temperature sensor and turns on the ultraviolet light source to increase the temperature of the feeding fluid to a temperature within the TNZ. The controller also alters the output of the ultraviolet light source such as by turning it off and on to maintain the temperature of the feeding fluid within the TNZ.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
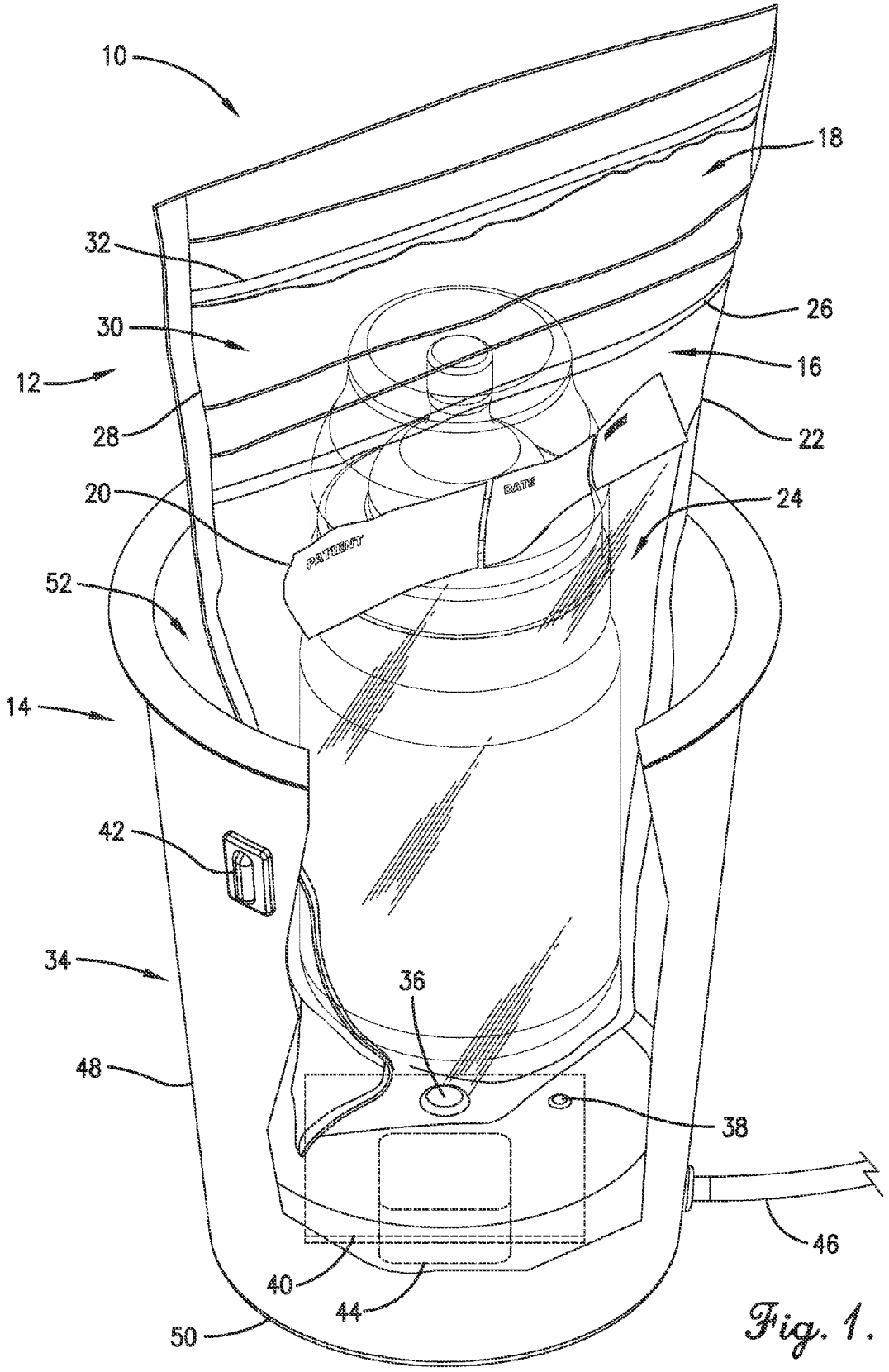
FIG. 1 is a perspective view of a feeding fluid warming system constructed in accordance with an embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
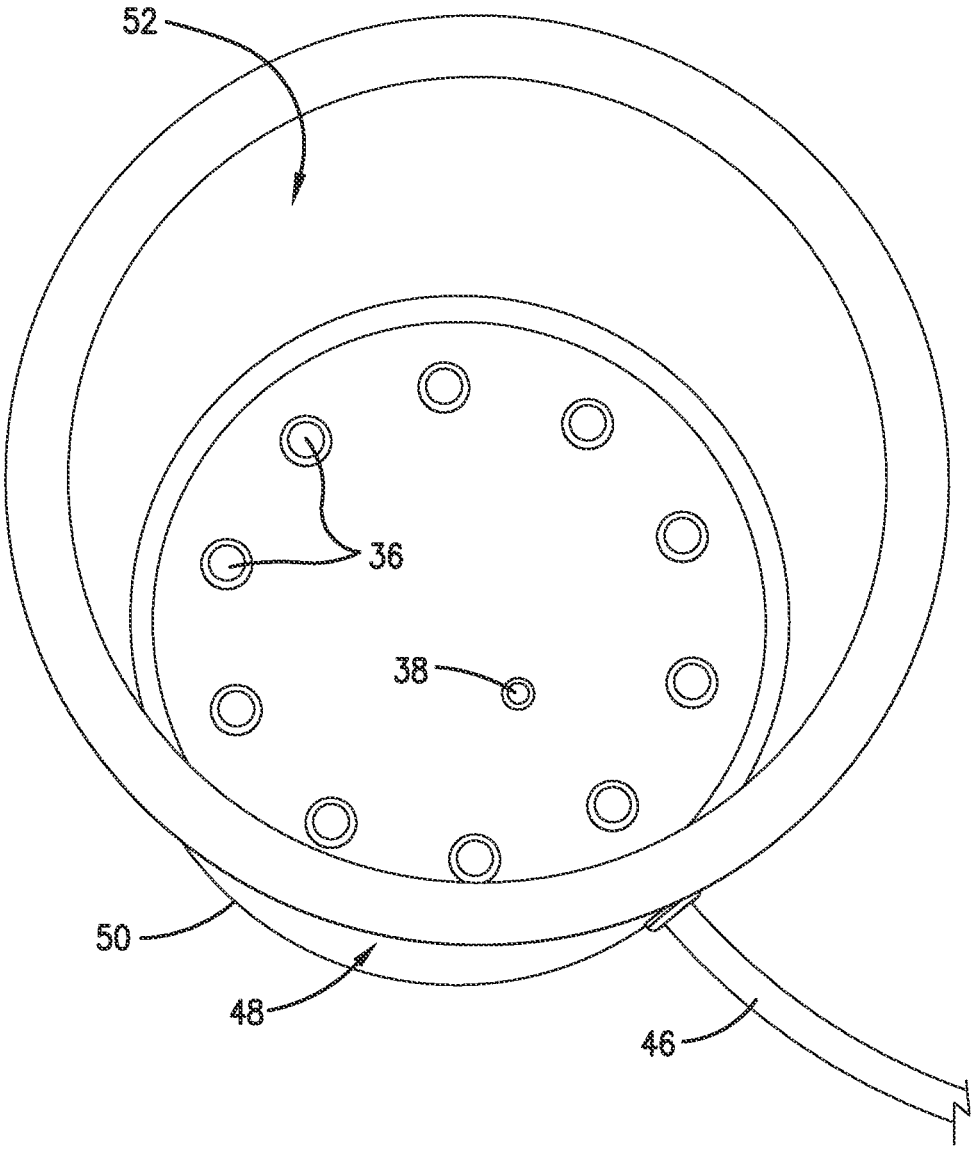
FIG. 2 is a sectional view of a feeding fluid warming device of FIG. 1.

Turning now to FIGS. 1 and 2, a feeding fluid warming system 10 constructed in accordance with an embodiment of the invention is illustrated. The feeding fluid warming system 10 broadly comprises a removable liner bag 12, similar to the one disclosed in U.S. Pat. No. 8,672,545 issued to Norman et al., and a warming device 14.

The removable liner bag 12 receives feeding fluid as described below and is formed of plastic or other suitable insulating material. The liner bag 12 includes an outer bag 16, an inner bag 18, and one or more labels 20.

The outer bag 16 holds a warming fluid therein and includes an ultraviolet light permeable outer wall 22 for allowing ultraviolet light to penetrate the warming fluid. The outer wall 22 defines an outer chamber 24 for receiving the warming fluid therein. The outer bag 16 may be permanently sealed shut or may have a recloseable seal 26, fastener, adhesive, nozzle, cap, or spout for replacing the warming fluid. The outer bag 16 may be impregnated or coated with an antimicrobial agent to inhibit the growth of bacteria and other organisms in the liner bag 12.

The inner bag 18 receives feeding fluid and is at least partially contained within the outer bag 16. The inner bag 18 includes an ultraviolet light unpermeable outer wall 28 for limiting the amount of ultraviolet light that is allowed to penetrate the feeding fluid. The outer wall 28 defines an inner chamber 30 for receiving feeding fluid therein. The inner bag 18 includes a recloseable seal 32, fastener, adhesive, nozzle, cap, or spout for removing or pouring out the feeding fluid. Alternatively, the inner bag 18 may have an artificial nipple or similar protrusion for allowing an infant to drink the feeding fluid directly from the inner bag 18. The inner bag 18 may be impregnated or coated with an antimicrobial agent to inhibit the growth of bacteria and other organisms in the liner bag 12. The inner bag 18 may also be configured to receive a bottle or similar feeding fluid receptacle therein (as shown in FIG. 1) so that the feeding fluid does not come in direct contact with the inner bag 18.

It will be understood by those skilled in the art that the outer bag 16 and the inner bag 18 may be reversed so that the outer bag 16 receives the feeding fluid and the inner bag 18 holds the warming fluid.

The labels 20 allow a user to mark identifying information directly on the liner bag 12 and may have designated sections for marking the information. For example, the labels 20 may have sections labeled "patient", "date", and "nurse" so that the user can later identify the liner bag 12. The labels 20 can be erased or cleaned so that the liner bag 12 can be reused.

The feeding fluid warming device 14 broadly comprises a container 34, an ultraviolet light source 36, a temperature sensor 38, a controller 40, an indicator 42, a vibrating mechanism 44, and a power source 46.

The container 34 receives the liner bag 12 or other feeding fluid receptacle and is formed of rigid or semi-rigid plastic, metal, ceramics, or any other suitable insulating material. The container 34 includes a sidewall 48 and a floor 50 that cooperatively define an interior chamber 52 for receiving the removable liner bag 12 therein.

The ultraviolet light source 36 heats and sterilizes the warming fluid and may be one or more ultraviolet light emitting diodes (LEDs), lamps, or other ultraviolet light emitting elements. The ultraviolet light source 36 produces wavelengths of between 100 nanometers to 280 nanometers and produces vacuum ultraviolet (VUV) and/or C-band ultraviolet (UVC) light. The ultraviolet light source may be embedded in or positioned on a central portion of the floor 50 of the container 34 or may be embedded in or positioned in a concentric ring on the floor 50 to more effectively transmit ultraviolet light to the warming fluid, as shown in FIG. 2.

The temperature sensor 38 senses a temperature of the warming fluid and may be a thermistor, thermocouple, or any other suitable temperature sensing component. The temperature sensor 38 is located in the outer bag 16 of the liner bag 12 or near the outer bag 16 to obtain accurate temperature readings of the warming fluid. Alternatively, the temperature sensor 38 may be located in the inner bag 18 to obtain direct temperature readings of the feeding fluid or embedded in or positioned on the sidewall 48 or floor 50 of the container 34.

The controller 40 may implement aspects of the present invention with one or more computer programs stored in or on computer-readable medium residing on or accessible by the controller 40. Each computer program preferably comprises an ordered listing of executable instructions for implementing logical functions in the controller 40. Each computer program can be embodied in any non-transitory computer-readable medium for use by or in connection with an instruction execution system, apparatus, or device, such as a computer-based system, processor-containing system, or other system that can fetch the instructions from the instruction execution system, apparatus, or device, and execute the instructions. In the context of this application, a "computer-readable medium" can be any non-transitory means that can store the program for use by or in connection with the instruction execution system, apparatus, or device. The computer-readable medium can be, for example, but not limited to, an electronic, magnetic, optical, electromagnetic, infrared, or semi-conductor system, apparatus, or device. More specific, although not exclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM). The controller 40 may include a printed circuit board, chip, and/or other similar electronic components and may be embedded in the sidewall 48 or floor 50 of the container 34 or mounted thereon.

The controller 40 receives signals representative of the temperature of the warming fluid or the feeding fluid from the temperature sensor 38 and turns on the ultraviolet light source 36 to increase the temperature of the warming fluid or the feeding fluid to a temperature within the TNZ. The controller 40 also alters the output of the ultraviolet light source 36 such as by turning the ultraviolet light source 36 off and on to maintain the temperature of the feeding fluid within the TNZ. The controller 40 may instead reduce the voltage or current supplied to the ultraviolet light source 36, reduce the number of lights that are turned on, or reduce the amount of light that is directed toward the warming fluid. For example, the controller 40 may turn off five of ten LEDs to stabilize the temperature of the feeding fluid. The controller 40 may also maintain the temperature of the feeding fluid at an intermediate temperature within the TNZ, such as 95° F. (35° C.), or within an intermediate temperature range, such as 93° F. (34° C.) to 97° F. (36° C.), by frequently activating and deactivating the ultraviolet light source 36 when the feeding fluid reaches these temperatures. This allows the temperature of the feeding fluid to remain relatively constant instead of rising and falling between the upper and lower threshold temperatures of the TNZ. The controller 40 also activates the vibrating mechanism 44, and the indicator 42, as described below.

The indicator 42 indicates whether the feeding fluid is at a temperature below the TNZ or within the TNZ and may be one or more LEDs or similar lights, an LCD display, a seven-segment display, an electronic display screen, a mechanical marker, a chime, a buzzer, or any other suitable indicator. The indicator 42 is positioned on the outside of the sidewall 48 of the container 34 or other accessible location so as to be easily viewed or heard by a caregiver. The indicator 42 may have only on and off states for indicating that the feeding fluid temperature is or is not within the TNZ or may have a third state such a "standby" or similar state for when the temperature of the feeding fluid is below the TNZ. For example, the indicator 42 may be a light that glows green when the feeding fluid is within the TNZ and is ready for consumption and glows red, orange, or yellow when the feeding fluid is below the TNZ and must be warmed before being consumed. The indicator 42 may also indicate an approximate time remaining until the feeding fluid is ready for consumption, a current temperature of the feeding fluid, or any other indication of a status of the feeding fluid. In addition, the indicator 42 may provide other information such as current date and time, the amount of time that has lapsed since the feeding fluid has been warmed or changed, the date and time that the feeding fluid was last warmed or changed, or any other information that may assist a caregiver in providing fresh and properly warmed feeding fluid.

The vibrating mechanism 44 mixes the warming fluid so that heat is more evenly distributed to the feeding fluid and so that the warming fluid is more effectively sterilized. The vibrating mechanism 44 is a small off-balance motor or similar device in the container 34 and may be embedded in or positioned on the sidewall 48 or floor 50 of the container 34 for effectively mixing the feeding fluid and/or for effectively mixing the warming fluid.

The power source 46 supplies electrical power to the above electrical components and may be a power cord for receiving power from a wall outlet, computer, car outlet, or other external power source, or may be a rechargeable battery pack or one or more disposable batteries.

Operation of the warming system 10 will now be described in more detail. First, a user or caregiver fills the inner bag 18 of the liner bag 12 with feeding fluid or inserts a feeding bottle filled with feeding fluid into the inner bag 18 of the liner bag 12. The user may also mark identifying information such as the name of the patient, the current date, and the patient's nurse on the labels 20 of the liner bag 12. The user then closes the recloseable seal 32 and inserts the liner bag 12 into the container 34 of the warming device 14. The user then plugs in the cord of the power source 46 or switches on the power source 46. The controller 40 will then automatically activate the ultraviolet light source 36, which will begin to heat up and sterilize the warming fluid in the outer bag 16 of the liner bag 12. The warming fluid will heat the feeding fluid in the inner bag 18 of the liner bag 12. Alternatively, the user may press a button or switch to begin the heating process. The controller 40 will also activate the vibrating mechanism 44 while the ultraviolet light source 36 is heating the warming fluid so that the warming fluid evenly distributes heat to the feeding fluid and so that the warming fluid is more effectively sterilized.

When the temperature sensor 38 senses that the feeding fluid has reached a temperature within the TNZ, the controller 40 will activate the indicator 42 to a "ready" state so that the user will know that the feeding fluid is ready for consumption. The user may then open the recloseable seal 32 and remove the feeding fluid from the inner bag 18 of the liner bag 12 when the infant is ready to consume the feeding fluid.

The controller 40 will begin to cycle the ultraviolet light source 36 or reduce the power of the ultraviolet light source 36 when the temperature of the feeding fluid reaches the TNZ to maintain the temperature of the feeding fluid within the TNZ until the feeding fluid is removed.

The feeding fluid may be refrigerated with the liner bag 12 in the interior chamber 52 of the warming device 14 or with the liner bag 12 removed from the warming device 14. The warming device 14 and/or the liner bag 12 may be dishwasher safe for ease of cleaning and are washable by hand. The ultraviolet light penetration of the outer bag 16 and the antimicrobial coatings of the outer bag 16 and inner bag 18 reduce the frequency at which the liner bag 12 must be washed.

The above-described feeding fluid warming system 10 provides several advantages over conventional warming systems. For example, the ultraviolet light sterilizes the warming fluid, liner bag 12 or other feeding fluid receptacle, and/or components of the warming device 14 so as to inhibit the growth of bacteria and microbes around the liner bag 12, other feeding fluid receptacle, or components of the warming device 14. This reduces the chances of harmful germs from being transferred to the infant. The feeding fluid being at least partially surrounded by the warming fluid evenly heats the feeding fluid by transferring heat to the feeding fluid over a large area. The vibrating mechanism 44 also helps the warming fluid more evenly heat the feeding fluid by mixing the warming fluid in the outer bag 16 and by mixing the feeding fluid in the inner bag 18. The indicator 42 ensures that the user knows when the feeding fluid is ready for consumption. The cup-shape of the container 34 in some embodiments of the present invention allows the warming device 14 to conveniently fit in a cup holder, a cup carrier, and a personal drink holder.

Figure 3:
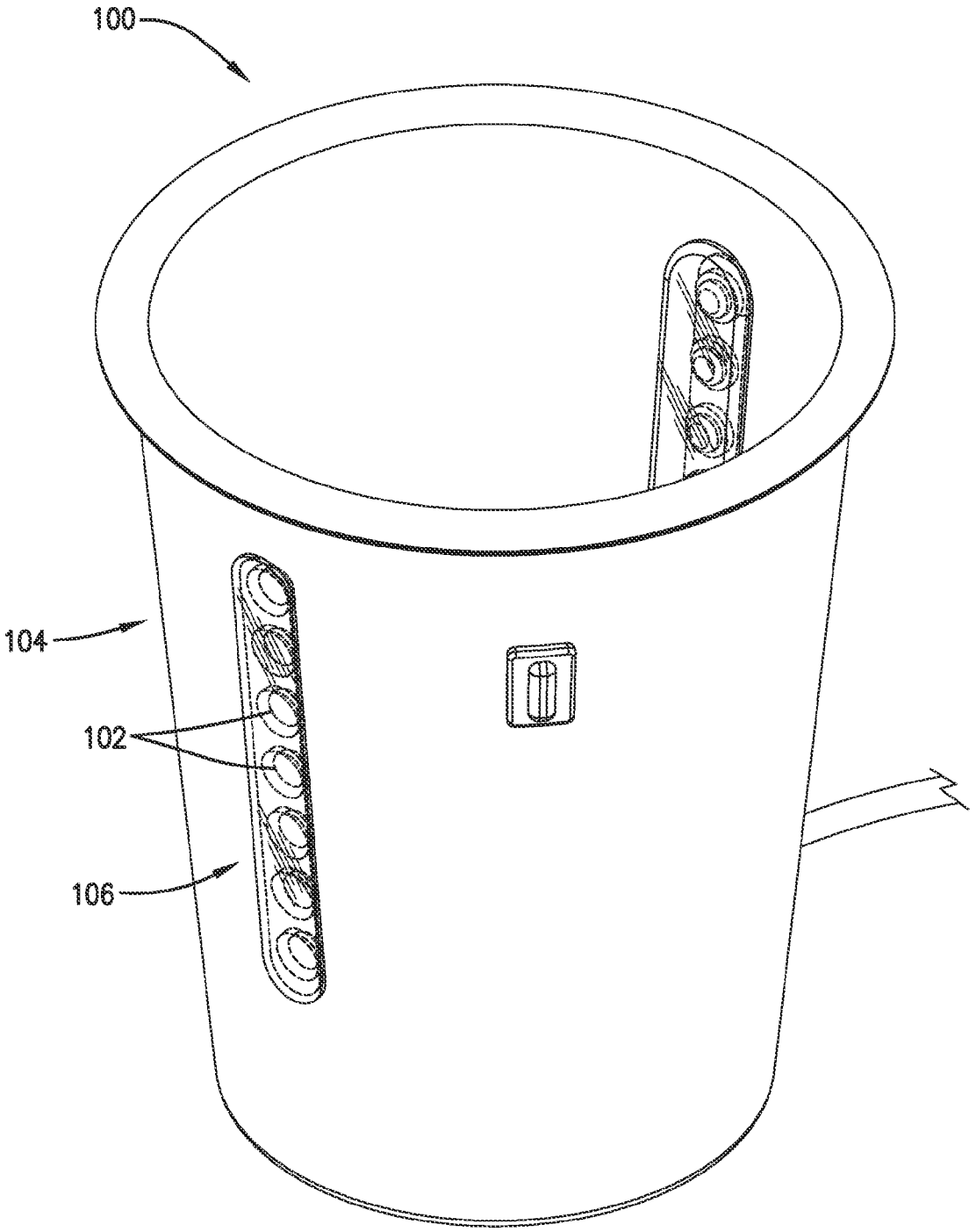
FIG. 3 is a perspective view of a feeding fluid warming device constructed in accordance with another embodiment of the invention.

Turning now to FIG. 3, a feeding fluid warming device 100 constructed in accordance with another embodiment of the present invention is illustrated. The feeding fluid warming device 100 is substantially similar to the above feeding fluid warming device 14 except that the ultraviolet light source 102 is located within the side or sides of the container 104. A transparent window 106 extending vertically long an outer side of the container 104 near the ultraviolet light source 102 allows a user to easily determine whether the ultraviolet light source 102 is currently heating the warming fluid and the feeding fluid. The transparent window 106 may also allow the user to visually inspect the amount of warming fluid and/or the amount of feeding fluid currently in the warming device 100.

Figure 4:
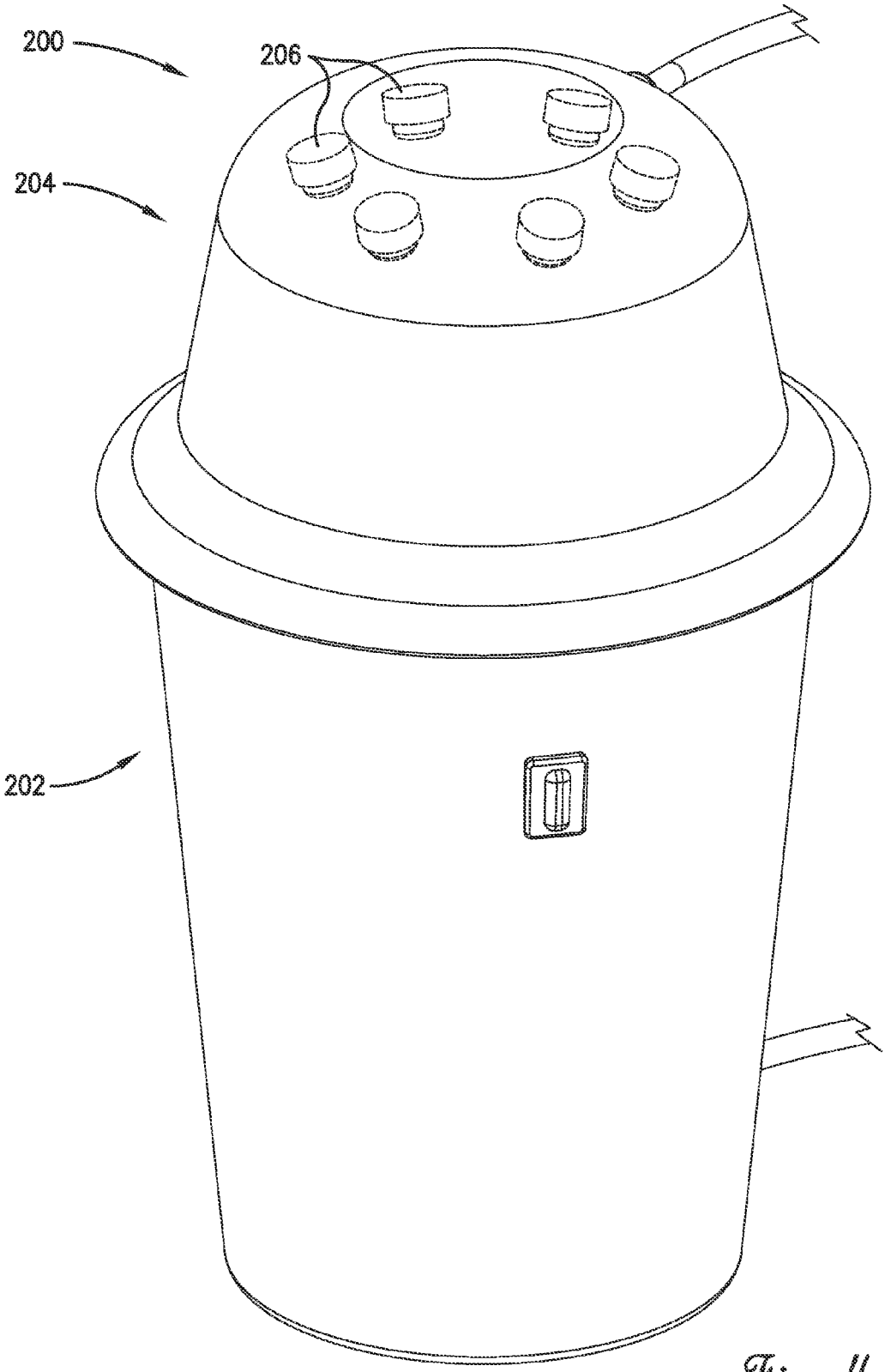
FIG. 4 is a perspective view of a feeding fluid warming device constructed in accordance with another embodiment of the invention.

Turning now to FIG. 4, a feeding fluid warming device 200 constructed in accordance with another embodiment of the present invention is illustrated. The feeding fluid warming device 200 is substantially similar to the above feeding fluid warming devices 14, 100 except that the container 202 includes a lid 204 or hood.

The lid 204 covers the top of the container 202 so as to enclose a liner bag within the container 202. The lid 204 houses the ultraviolet light source 206, the controller, and other electronic components. The lid 204 helps retain heat in the liner bag so as to more effectively warm the feeding fluid.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A feeding fluid warming system comprising:
- a removable liner bag comprising:
  - an outer bag having an ultraviolet light permeable outer wall defining an outer chamber for holding a warming fluid; and
  - an inner bag at least partially contained within the outer bag, the inner bag having an ultraviolet light unpermeable outer wall defining an inner chamber for receiving a feeding fluid; and
- a warming device comprising:
  - a container including a sidewall and a floor cooperatively defining an interior chamber for receiving the removable liner bag therein; and
  - an ultraviolet light source configured to emit ultraviolet light into the outer bag for sterilizing the warming fluid and for heating the warming fluid to warm the feeding fluid in the inner bag.

2. The feeding fluid warming system of claim 1, wherein the ultraviolet light source is a lamp.

3. The feeding fluid warming system of claim 1, wherein the ultraviolet light source comprises a plurality of ultraviolet C-band light emitting diodes.

4. The feeding fluid warming system of claim 1, wherein the ultraviolet light source comprises at least one vacuum ultraviolet light.

5. The feeding fluid warming system of claim 1, wherein the ultraviolet light source is embedded in the floor of the container.

6. The feeding fluid warming system of claim 1, wherein the ultraviolet light source comprises a plurality of lights arranged in a ring around the floor of the container for efficiently emitting ultraviolet light into the outer bag.

7. The feeding fluid warming system of claim 1, wherein the ultraviolet light source is embedded in the sidewall of the container.

8. The feeding fluid warming system of claim 7, wherein the sidewall includes a transparent window facing outward from the container for allowing a user to easily ascertain whether the ultraviolet light source is activated.

9. The feeding fluid warming system of claim 1, wherein the warming device further comprises a lid housing the ultraviolet light source.

10. The feeding fluid warming system of claim 1, wherein the outer bag includes an anti-microbial coating configured to inhibit the growth of bacteria and other organisms in the outer bag.

11. The feeding fluid warming system of claim 1, wherein the inner bag includes an anti-microbial coating configured to inhibit the growth of bacteria and other organisms in the inner bag.

12. The feeding fluid warming system of claim 1, wherein the warming device further comprises a controller configured to turn the ultraviolet light source off after a predetermined time interval for effectively sterilizing the warming fluid.

13. The feeding fluid warming system of claim 1, wherein the warming device further comprises a temperature sensor configured to sense a temperature of the warming fluid and a controller connected to the temperature sensor and configured to turn on the ultraviolet light source to increase the temperature of the feeding fluid to at least 90 degrees Fahrenheit and to alter the output of the ultraviolet light source to maintain the temperature of the feeding fluid between 90 degrees Fahrenheit and 100 degrees Fahrenheit.

14. The feeding fluid warming system of claim 13, wherein the warming device further comprises an indicator, the controller being further configured to activate the indicator when the temperature of the feeding fluid reaches 90 degrees.

15. The feeding fluid warming system of claim 1, wherein the warming device further comprises a vibrating mechanism configured to mix the warming fluid to ensure that the warming fluid is effectively sterilized.

16. The feeding fluid warming system of claim 15, wherein the vibrating mechanism is embedded in the floor of the container.

17. The feeding fluid warming system of claim 15, wherein the vibrating mechanism is embedded in the sidewall of the container.

18. The feeding fluid warming system of claim 1, wherein the liner bag further comprises a number of designated areas for marking identification information of the feeding fluid on the liner bag.

19. A feeding fluid warming system comprising:
- a removable liner bag comprising:
  - an outer bag having an ultraviolet light permeable outer wall defining an outer chamber for holding a warming fluid; and
  - an inner bag at least partially contained within the outer bag and having an ultraviolet light unpermeable outer wall defining an inner chamber for receiving a feeding fluid; and
- a warming device comprising:
  - a container including a sidewall and a floor cooperatively defining an interior chamber for receiving the liner bag therein;
  - a plurality of ultraviolet light emitting diodes embedded in the container, the ultraviolet light emitting diodes being configured to emit ultraviolet light into the outer bag for sterilizing the warming fluid and for heating the warming fluid to warm the feeding fluid in the inner bag;
  - a vibrating mechanism being configured to mix the warming fluid to ensure that the warming fluid is sterilized;

a temperature sensor for sensing a temperature of the warming fluid;

an indicator; and a controller connected to the temperature sensor and the indicator, the controller being configured to:

turn on the ultraviolet light source to increase the temperature of the feeding fluid to at least 90 degrees Fahrenheit;

activate the indicator when the temperature of the feeding fluid has risen to at least 90 degrees Fahrenheit; and alter the output of the ultraviolet light source to maintain the temperature of the feeding fluid between 90 degrees Fahrenheit and 100 degrees Fahrenheit.

* * * * *